US012325564B2

(12) United States Patent
Hengami

(10) Patent No.: US 12,325,564 B2
(45) Date of Patent: Jun. 10, 2025

(54) SEAL ENDS BOX WITH HORIZONTAL SLIDE OPENINGS FOR DISPENSING

(71) Applicant: David Hengami, Torrance, CA (US)

(72) Inventor: David Hengami, Torrance, CA (US)

( * ) Notice: Subject to any disclaimer, the term of this patent is extended or adjusted under 35 U.S.C. 154(b) by 0 days.

(21) Appl. No.: 18/571,389

(22) PCT Filed: Jun. 23, 2022

(86) PCT No.: PCT/US2022/034764

§ 371 (c)(1),
(2) Date: Dec. 18, 2023

(87) PCT Pub. No.: WO2022/271971

PCT Pub. Date: Dec. 29, 2022

(65) Prior Publication Data

US 2024/0270437 A1 Aug. 15, 2024

Related U.S. Application Data

(60) Provisional application No. 63/214,370, filed on Jun. 24, 2021.

(51) Int. Cl.
*B65D 5/72* (2006.01)
*B65D 5/02* (2006.01)

(52) U.S. Cl.
CPC ..... *B65D 5/0254* (2013.01); *B65D 5/723* (2013.01)

(58) Field of Classification Search
CPC ..... B65D 5/723
USPC ..... 229/129.1, 122, 131.1, 125.125, 220
See application file for complete search history.

(56) References Cited

U.S. PATENT DOCUMENTS 1,543,953 A 6/1925 Rothschild
1,951,274 A 3/1934 Denman
2,000,210 A 5/1935 Bayless
(Continued)

FOREIGN PATENT DOCUMENTS

CN 204399639 6/2015
DE 10044018 3/2002
(Continued)

OTHER PUBLICATIONS

International Search Report and Written Opinion from PCT/US2022/034764 dated Oct. 19, 2022.
(Continued)

*Primary Examiner* — Nathan J Newhouse
*Assistant Examiner* — Phillip D Schmidt
(74) *Attorney, Agent, or Firm* — Concourse Law Group; Katherine B. Sales, Esq.

(57) ABSTRACT

A blank for folding into a box, and a method of folding same. The blank has a top end, a bottom end, an interior front panel, a first side panel foldably connected to the interior front panel, a second side panel foldably connected to the interior front panel opposite the first side panel, a rear panel foldably connected to the second side panel opposite the interior front panel, a third side panel foldably connected to the rear panel opposite the second side panel, an exterior front panel foldably connected to the third side panel opposite the rear panel, a slide formed by a portion of the third side panel and the exterior front panel, and a second catch formed by a portion of the exterior front panel.

9 Claims, 8 Drawing Sheets

(56) References Cited

U.S. PATENT DOCUMENTS 2,330,926 A * 10/1943 Rous ..... B65D 5/723 229/220
2,342,081 A 2/1944 Kirkland et al.
2,349,748 A 5/1944 Otto
2,507,430 A 5/1950 Yancey
2,567,017 A * 9/1951 Gillespie ..... B65D 5/721 229/130
2,857,881 A 10/1958 Beebe
2,903,175 A 9/1959 Peimer
2,950,851 A 8/1960 Peimer
2,983,421 A 5/1961 Turpin
2,983,424 A 5/1961 Glass
3,009,565 A 11/1961 Leone
3,016,178 A 1/1962 Knocks
3,033,436 A 5/1962 Peimer
3,040,953 A 6/1962 Tindall
3,079,062 A 2/1963 Craddock
3,082,929 A 3/1963 Aquino et al.
3,115,290 A 12/1963 Byassee
3,126,141 A 3/1964 Walter
3,229,888 A 1/1966 Gillam
3,438,482 A 4/1969 Hamilton
3,441,125 A 4/1969 Small
3,539,089 A 11/1970 Osberg
3,610,510 A 10/1971 Lowry
3,669,336 A 6/1972 Robinson
3,819,093 A 6/1974 Forbes
3,907,108 A 9/1975 Weimer
4,054,203 A 10/1977 Farquhar
4,063,679 A 12/1977 Henry
4,081,128 A 3/1978 O'Neill
4,094,456 A 6/1978 Roccaforte
4,141,485 A 2/1979 Lambert
4,197,985 A * 4/1980 Austin ..... B65D 5/723 222/456
4,201,329 A 5/1980 Roccaforte
4,274,578 A 6/1981 Montealegre
4,349,105 A 9/1982 Bradley et al.
4,361,270 A 11/1982 Roccaforte
4,438,848 A 3/1984 Montealegre
4,452,355 A 6/1984 Benham
4,548,318 A 10/1985 Boyle
4,609,142 A 9/1986 Adamek
5,040,721 A 8/1991 Essack
D319,976 S 9/1991 Wortley et al.
D320,935 S 10/1991 Nylander
5,056,708 A 10/1991 Boyle
5,135,158 A 8/1992 Boyle et al.
5,145,070 A 9/1992 Pallett et al.
5,197,625 A 3/1993 Mullaney
5,348,219 A 9/1994 Brintazzol
D361,262 S 8/1995 Lusker
5,465,834 A 11/1995 Sieber et al.
5,505,370 A 4/1996 Brown et al.
5,505,373 A 4/1996 Von Stillfried
5,540,330 A 7/1996 Lo Duca
5,607,058 A 3/1997 Huesman et al.
D390,330 S 2/1998 Skaya
5,725,620 A 3/1998 Perea et al.
5,845,424 A 12/1998 Mitchell
5,918,799 A 7/1999 Walsh
5,927,498 A 7/1999 Saam
D425,413 S 5/2000 Heeley et al.
6,079,563 A 6/2000 Katchmazenski
6,116,499 A 9/2000 Hengami
6,227,440 B1 5/2001 Hart
6,273,332 B1 8/2001 Hengami
6,360,942 B2 3/2002 Hengami
D455,455 S 4/2002 Katsuyama
6,393,707 B1 5/2002 Maffei
6,394,275 B1 5/2002 Paliotta et al.
6,435,402 B1 8/2002 Hengami
6,474,040 B1 11/2002 Ours et al.
6,637,646 B1 10/2003 Muise et al.
6,691,869 B2 2/2004 Knaack et al.
6,733,555 B1 5/2004 Wilder
6,889,892 B2 5/2005 Walsh et al.
D508,850 S 8/2005 Ghini et al.
6,945,449 B2 9/2005 Hengami
6,971,524 B1 12/2005 Voswinkel
7,040,528 B2 5/2006 Hengami
7,097,043 B2 8/2006 Hsu
7,156,286 B2 1/2007 Hengami
D551,967 S 10/2007 Hengami
D552,987 S 10/2007 Magnusson
7,337,904 B2 3/2008 Hengami
D580,754 S 11/2008 An
7,494,044 B2 2/2009 Walsh et al.
7,503,475 B2 3/2009 McGowan
D594,743 S 6/2009 Lukka
7,661,578 B2 2/2010 Li
7,743,973 B2 * 6/2010 Hegami ..... B65D 5/723 229/122
7,992,764 B2 8/2011 Magnusson
8,261,964 B2 9/2012 Raupach et al.
8,499,999 B2 8/2013 Sieber et al.
8,739,969 B2 6/2014 Schuld
8,800,855 B2 8/2014 Fitzwater
8,844,797 B2 9/2014 Smith
9,085,386 B2 7/2015 Hengami
9,394,066 B2 7/2016 Hengami
9,394,076 B2 7/2016 Hengami
9,561,878 B2 2/2017 Lee et al.
9,643,749 B2 5/2017 Wagner
10,086,990 B2 * 10/2018 Hengami ..... B65D 85/60
10,899,496 B2 1/2021 Hengami
11,066,209 B2 7/2021 Hengami
11,111,052 B2 9/2021 Hengami
11,180,281 B2 * 11/2021 Hengami ..... B65D 5/723
11,186,405 B2 11/2021 Hengami
11,220,369 B2 1/2022 Hengami
11,292,634 B2 4/2022 Hengami
11,661,232 B2 5/2023 Hengami
11,667,431 B1 6/2023 Hengami
11,691,779 B2 7/2023 Hengami
11,691,783 B1 7/2023 Hengami
2003/0217944 A1 11/2003 Belloli et al.
2003/0230498 A1 12/2003 Maute
2004/0065723 A1 4/2004 Hengami
2005/0061864 A1 3/2005 Lee
2005/0067476 A1 * 3/2005 Hengami ..... B65D 5/723 229/110
2005/0098616 A1 5/2005 Chang
2005/0211754 A1 9/2005 Fulcher
2006/0124709 A1 6/2006 Hengami
2007/0251848 A1 11/2007 Hengami
2007/0261990 A1 11/2007 Weston et al.
2008/0128478 A1 6/2008 Quadrelli
2008/0128480 A1 6/2008 Hengami
2011/0057024 A1 3/2011 Sieber et al.
2011/0062175 A1 3/2011 Nakamura et al.
2011/0111938 A1 5/2011 Smith
2011/0162997 A1 7/2011 Robbins et al.
2011/0168767 A1 7/2011 Hengami
2013/0075462 A1 3/2013 Jones et al.
2015/0321788 A1 11/2015 Hengami
2016/0297589 A1 10/2016 You et al.
2019/0144156 A1 5/2019 Hengami
2020/0087026 A1 * 3/2020 Hengami ..... B65D 5/48014
2021/0122519 A1 4/2021 Hengami

FOREIGN PATENT DOCUMENTS

EP 0642977 3/1995
EP 0732269 9/1996
EP 0761550 3/1997
FR 2799743 4/2001
JP 07223634 8/1995

OTHER PUBLICATIONS

PCT/US2011/021014. International Search Report and Written Opinion dated Jan. 12, 2011. 9 pages.

(56) References Cited

OTHER PUBLICATIONS

PCT/US2022/34764. International Search Report and Written Opinion dated Oct. 19, 2022.
https://issuu.com/designpackaging/docs/packaging-dielines-free-book-design Packaging & Dielines: The Designer's Book of Packaging Dieline; published at least as early as Sep. 18, 2019; 2 pages.
http://samanthaleewalker.blogspot.in/2012/12/ornament-box-tutorial.html Samantha Walker's Imaginary World: Ornamental Box Tutorial; retrieved Aug. 2, 2018; 1 page.
https://www.pinterest.se/pin/15692298672213867/?lp=true Corrugated Box with internal insert #packaging; retrieved Aug. 2, 2018; 1 page.

* cited by examiner

SEAL ENDS BOX WITH HORIZONTAL SLIDE OPENINGS FOR DISPENSING

CROSS-REFERENCE TO RELATED APPLICATIONS

This U.S. Non-Provisional Patent Application is U.S. National Stage entry under 35 USC 371 and claims priority to PCT Application No. PCT/US2022/034764, titled "Seal Ends Box with Horizontal Slide Openings for Dispensing," filed Just 23, 2022, which claims priority to U.S. Provisional Patent Application No. 63/214,370, titled "Seal Ends Box with Horizontal Slide Openings for Dispensing," filed Jun. 24, 2021, the contents of which are incorporated by reference herein in their entirety.

BACKGROUND

Clever product packaging, from both a functional and aesthetic standpoint, is proven to drive and generate sales. Applicant is the named inventor on numerous U.S. patents directed to specialty packaging including, for example, U.S. Pat. Nos. 7,337,904, 9,085,386 and 9,394,076. Applicant is also the inventor of the subject matter disclosed in abandoned U.S. application Ser. No. 11/321,283 published Jun. 15, 2006 and entitled "Convenient Solid Product Dispensing Package."

While Applicant's packages described in the patents and published applications offer many advantages including easy opening/closing, most are not truly pocket sized nor easily entirely operable with one hand or have other disadvantages. For example, for the candy/mint boxes disclosed in the patents mentioned above, the slide opening operates in conjunction with the top of the box. If these boxes are held upright in one hand and actuated by a user's thumb to partially open the top of the box, the user's thumb tends to block the product being dispensed.

Applicant has continued to develop boxes of new and differing functionality which offer improvements over the prior art including ease of operation. Applicant is also the inventor of the U.S. Pat. No. 7,743,973 entitled "Thumb-Actuated Candy Or Mix Box" which discloses a box formed by a single blank sheet or paper or cardboard stock with a horizontal, thumb-activated slide opening. The packaging apparatus of the '973 patent, however, has a flap forming the top closure of the box, but which vertically protrudes from the blank thus wasting a significant amount of the blank upon assembly of the box. Additionally, a flap that houses the thumb-actuated slide was designed to be formed and glued during filling, thus slowing the process.

Accordingly, one important objective of the present apparatus is to provide a package that offers double conventional seal ends that can be loaded from the top or bottom of the box and having the convenient slide opening for dispensing product. Another objective is to offer a slide opening that moves in a sideways direction perpendicular to the top opening of the box, that can be actuated by a user's thumb and tending not to block the opening. Other objectives include providing a package that is easily held and actuated by a single hand, can be easily dispensed while the user is driving without overly distracting or interfering with the user's operation of the moving vehicle, and which can be sized to fit well into a user's pocket. It is a still further objective of the present apparatus to provide such a box that is inexpensive and easy to manufacture on a mass scale, for example being made from a single sheet of blank stock and with minimal discard of the blank. Lastly, another objective is to provide packaging designed to form the flap that houses the actuation slide at the packaging house, such that the blank is ready to be formed into a box and filled during the filling process and using a standard filling machine.

SUMMARY

The present invention addresses this need. The present invention is directed to a blank for folding into a box. The blank comprises a top end, a bottom end, an interior front panel, a first side panel foldably connected to the interior front panel, a second side panel foldably connected to the interior front panel opposite the first side panel, a rear panel foldably connected to the second side panel opposite the interior front panel, a third side panel foldably connected to the rear panel opposite the second side panel, an exterior front panel foldably connected to the third side panel opposite the rear panel, a slide formed by a portion of the third side panel and the exterior front panel, and a second catch formed by a portion of the exterior front panel.

The interior front panel can have a first aperture adjacent the top end of the interior front panel, a second aperture adjacent the bottom end of the interior front panel, a first catch, and a pair of ears foldably connected to the interior front panel.

The first side panel can have a closing tab foldably connected to the first side panel, a first side panel top tab foldably connected to the top end of the first side panel, and a front panel tab foldably connected to the top end of the interior front panel.

The second side panel can have a second side panel top tab foldably connected to the top end of the second side panel, and a second side panel bottom tab foldably connected to the bottom end of the second side panel.

The rear panel can have a rear panel top tab foldably connected to the top end of the rear panel, the rear panel top tab having an insertion tab foldably connected thereto, and a real panel bottom tab foldably connected to the bottom end of the rear panel.

The slide can have a first portion, a second portion having a pair of slide stops at an end of the second portion of the slide, and a cut, wherein when the slide is folded, a slide tab is formed that is configured for engagement with a user's thumb.

The present invention is also directed to a method of folding the blank into a box. The method comprises the steps of: folding up the closing tab, first side panel, interior front panel, second side panel, rear panel, third side panel and exterior front panel; folding across a middle portion of the slide adjacent the slide tab; gluing exterior front panel to interior front panel; gluing closing tab to an interior surface of rear panel; folding the second side panel bottom tab, rear panel bottom tab, third side panel bottom tab and exterior front panel tab to close the bottom end of the blank; folding the first side panel top tab, second side panel top tab and rear panel top tab substantially 90 degrees; folding the insertion tab substantially 90 degrees respective to the rear panel top tab such that the insertion tab inserts behind the top end of interior front panel; folding the slide such that the first portion overlaps the first side panel, and second portion overlaps the interior front panel; folding the front panel tab substantially 180 degrees such that the front panel tab overlaps the second portion of the slide, interior front panel and a portion of the exterior front panel, and the first aperture and second aperture align to form a single opening, thereby forming a space between the front panel tab and interior front panel to house the slide therebetween.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION

Figure 1:
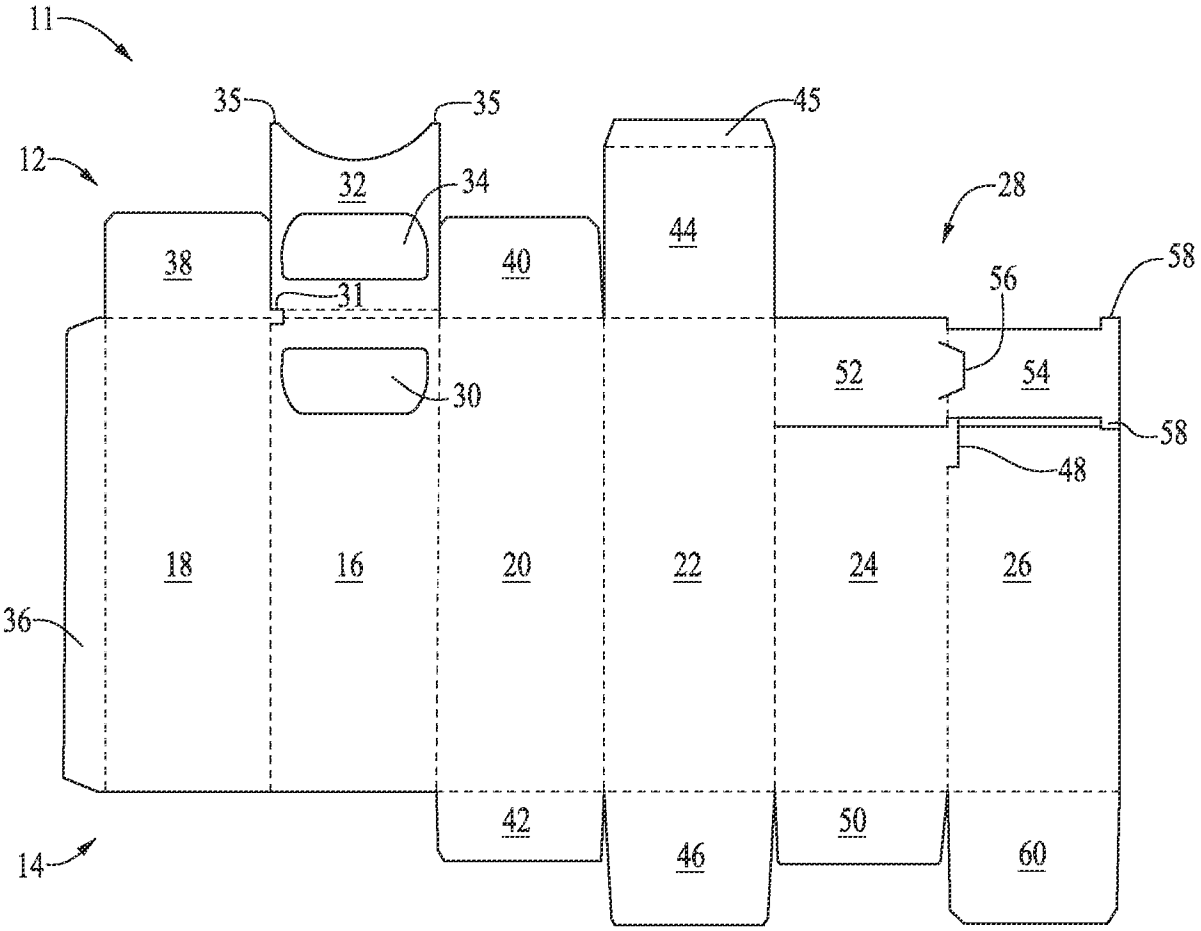
FIG. 1 is a flat pattern view of a single cardboard blank from which a first embodiment of the box is made.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a device disclosed in this disclosure will be determined by its intended use.

Referring now to the drawings, wherein like reference numerals designate identical or corresponding features throughout the several views. Further, described herein are certain non-limiting embodiments of my invention.

FIG. 1 shows a first embodiment of a flat pattern of a single blank sheet or paper or cardboard stock 11 used to make a box 10 (FIGS. 2-6) for solid, pourable food products such as small candies or mints. The blank 11 has a top end 12 and a bottom end 14 and is scored for folding between six (6) major sides including an interior front panel 16, a first side panel 18, a second side panel 20, a rear panel 22, a third side panel 24 and an exterior front panel 26.

Still referring to FIG. 1, a closing tab 36 is foldably connected to the first side panel 18, and the interior front panel 16 is foldably connected to the first side panel 18 opposite the closing tab 36. The first side panel 18 includes a first side panel top tab 38 foldably connected to the top end 12 of the first side panel 18. The interior front panel 16 includes a first aperture 30 adjacent the top end 12 of the interior front panel 16, and a front panel tab 32 foldably connected to the top end 12 of the interior front panel 16. A portion of the interior front panel 16 is cut away to form a first catch 31. The front panel tab 32 includes a second aperture 34 adjacent the bottom end 14 of the front panel tab 32 and preferably has a pair of ears 35 at the top end 12. The ears 35 of the front panel tab 32, and the closing tab 36 foldably connected to the first side panel 18 may serve as areas to apply glue or other adhesive to hold the constructed box 10 together. The second side panel 20 is foldably connected to the interior front panel 16 opposite the first side panel 18 and includes a second side panel top tab 40 foldably connected to the top end 12, and a second side panel bottom tab 42 foldably connected to the bottom end 14 of the second side panel 20. The rear panel 22 is foldably connected to the second side panel 20 opposite the interior front panel 16 and includes a rear panel top tab 44 foldably connected to the top end 12, and a rear panel bottom tab 46 foldably connected to the bottom end 14 of the rear panel 22. An insertion tab 45 is foldably connected to the rear panel top tab 44 opposite the rear panel 22.

Still referring to FIG. 1, the third side panel 24 is foldably connected to the rear panel 22 opposite the second side panel 20, and the exterior front panel 26 is foldably connected to the third side panel 24 opposite the rear panel 22. A portion of the third side panel 24 and exterior front panel 26 are cut away during manufacture to form a slide 28. The slide 28 includes a first portion 52 and second portion 54 and includes a cut such that when folded, forms a slide tab 56 configured for engagement by a user's thumb. Additionally, a portion of the exterior front panel 26 is cut away to form a second catch 48 that corresponds in configuration with a pair of slide stops 58 at the end of the second portion 54 of the slide 28.

The box 10 is constructed by folding the blank 11 in a particular sequence such that no specialized automated packaging machinery is needed to insert the slide 28 within the box 10. Still referring to FIG. 1, the construction begins by folding up the closing tab 36, first side panel 18, interior front panel 16, second side panel 20, rear panel 22, third side panel 24 and exterior front panel 26, and folding across the middle portion of the slide 28 adjacent the slide tab 56. When all panels are folded, exterior front panel 26 overlaps with and is potentially glued to interior front panel 16 and closing tab 36 is glued to an interior surface of rear panel 22 proximate the fold line between rear panel 22 and third side panel 24. Then, the second side panel bottom tab 42, rear panel bottom tab 46, third side panel bottom tab 50 and exterior front panel tab 60 may then be folded to close the bottom end 14 of the box 10.

Figure 2:
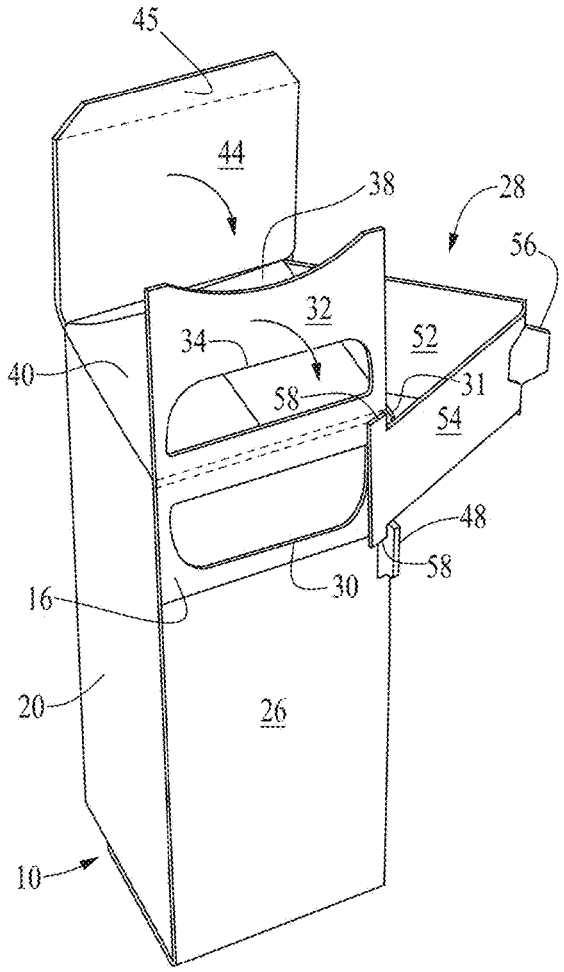
FIG. 2 is a front perspective view of the partially constructed box of the first embodiment showing the structure that provides the horizontal slide.

Referring to FIG. 2, next assembly steps may be folding the first side panel top tab 38, second side panel top tab 40 and rear panel top tab 44 substantially 90 degrees towards the interior of the box 10. The insertion tab 45 is folded substantially 90 degrees respective to the rear panel top tab 44 such that the insertion tab 45 inserts behind the top end 12 of interior front panel 16 and within the interior of the box 10. The slide 28 is folded such that the first portion 52 overlaps the first side panel 18, and second portion 54 overlaps the interior front panel 16. The first catch 31 and second catch 48 prevent advancement of the slide stops 58 beyond the third side panel 24 and keep the slide 28 contained in the box 10. A next assembly step may be folding the front panel tab 32 substantially 180 degrees such that the front panel tab 32 overlaps the second portion 54 of the slide 28, interior front panel 16 and a portion of the exterior front panel 26, and the first aperture 30 and second aperture 34 align to form a single opening in the box 10. A space is thereby formed between the front panel tab 32 and interior front panel 16 to house the slide 28 therebetween.

Figure 3:
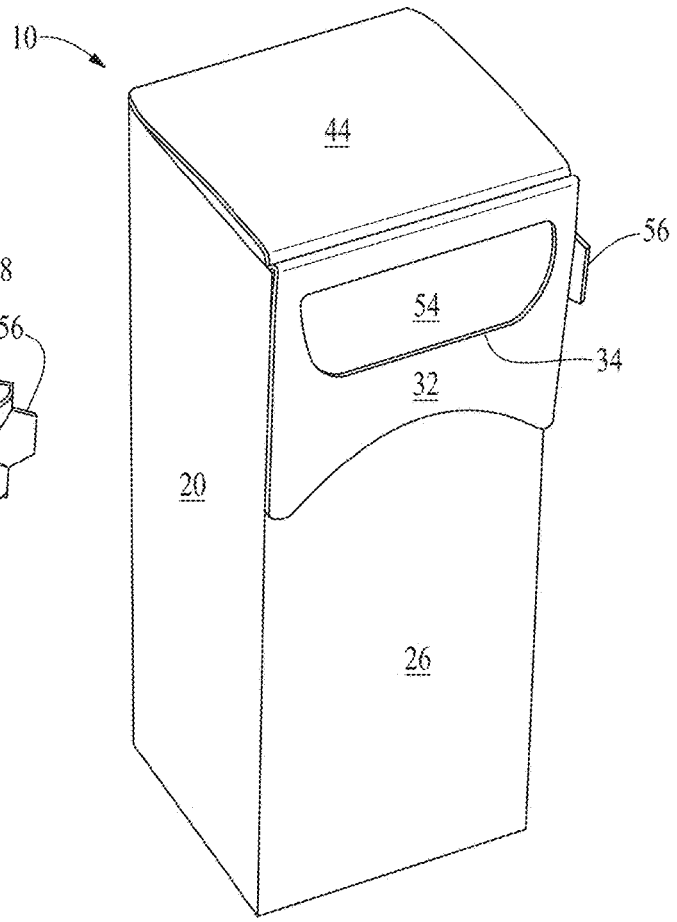
FIG. 3 is a front perspective view of the constructed box.

FIG. 3 shows the box 10 in complete assembly with the slide 28 contained within the box 10 and slide tab 56 is still fully accessible.

Figure 4:
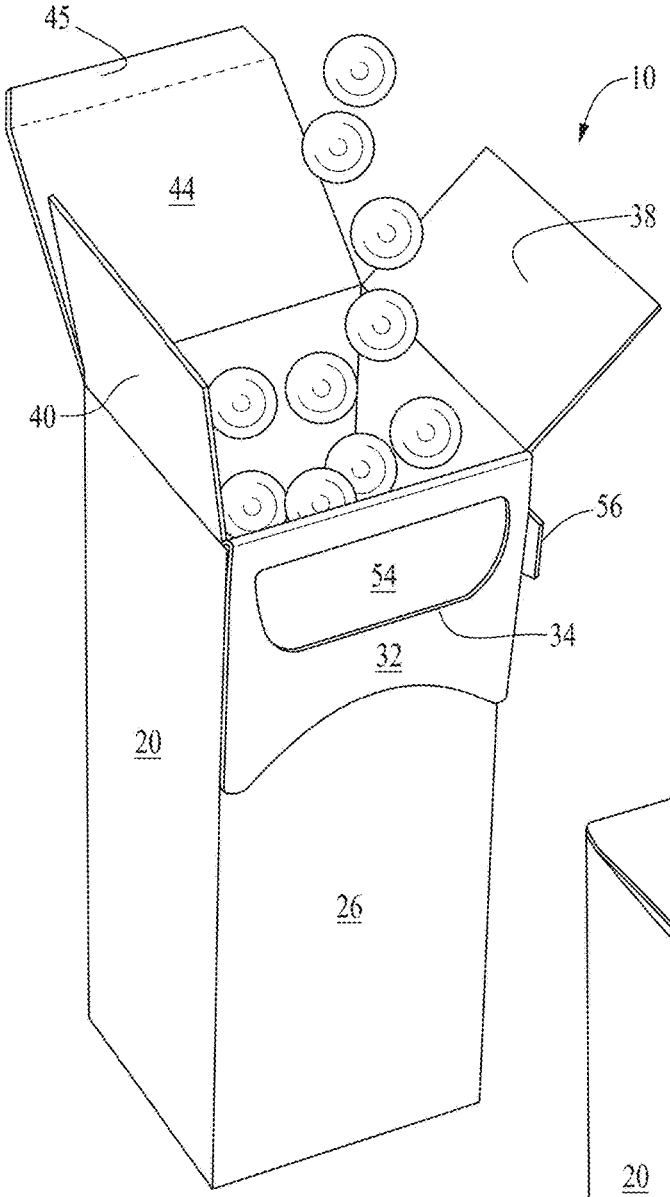
FIG. 4 is a front perspective view of the box being filled from the top.

FIG. 4 shows the fully-constructed box 10 being filled from the top, although the box 10 may be filled from the bottom (not shown).

Figure 5:
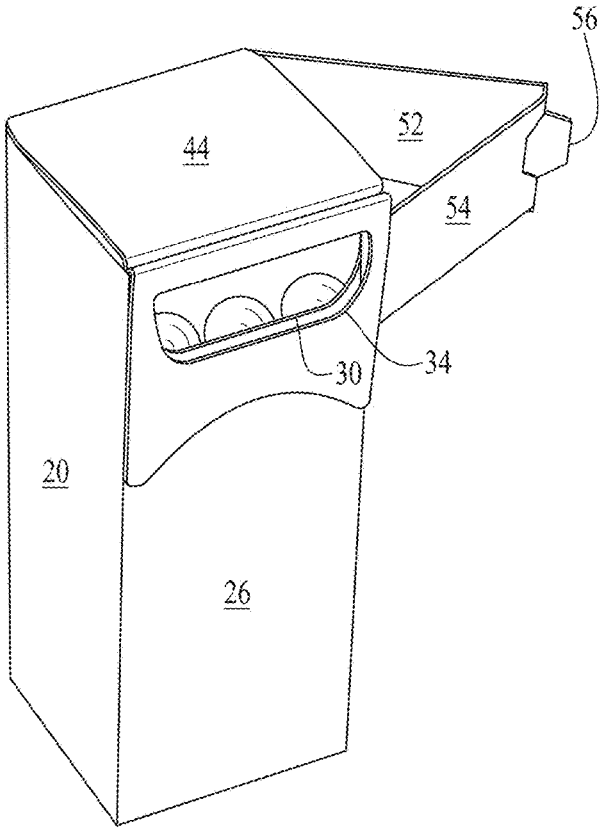
FIG. 5 is a front perspective view of the box showing operation of the horizontal slide.

FIG. 5 shows dispensing of product through the first aperture 30 and second aperture 34 after the slide 28 has been moved sideways unblocking the first aperture 30 and second aperture 34.

Figure 6:
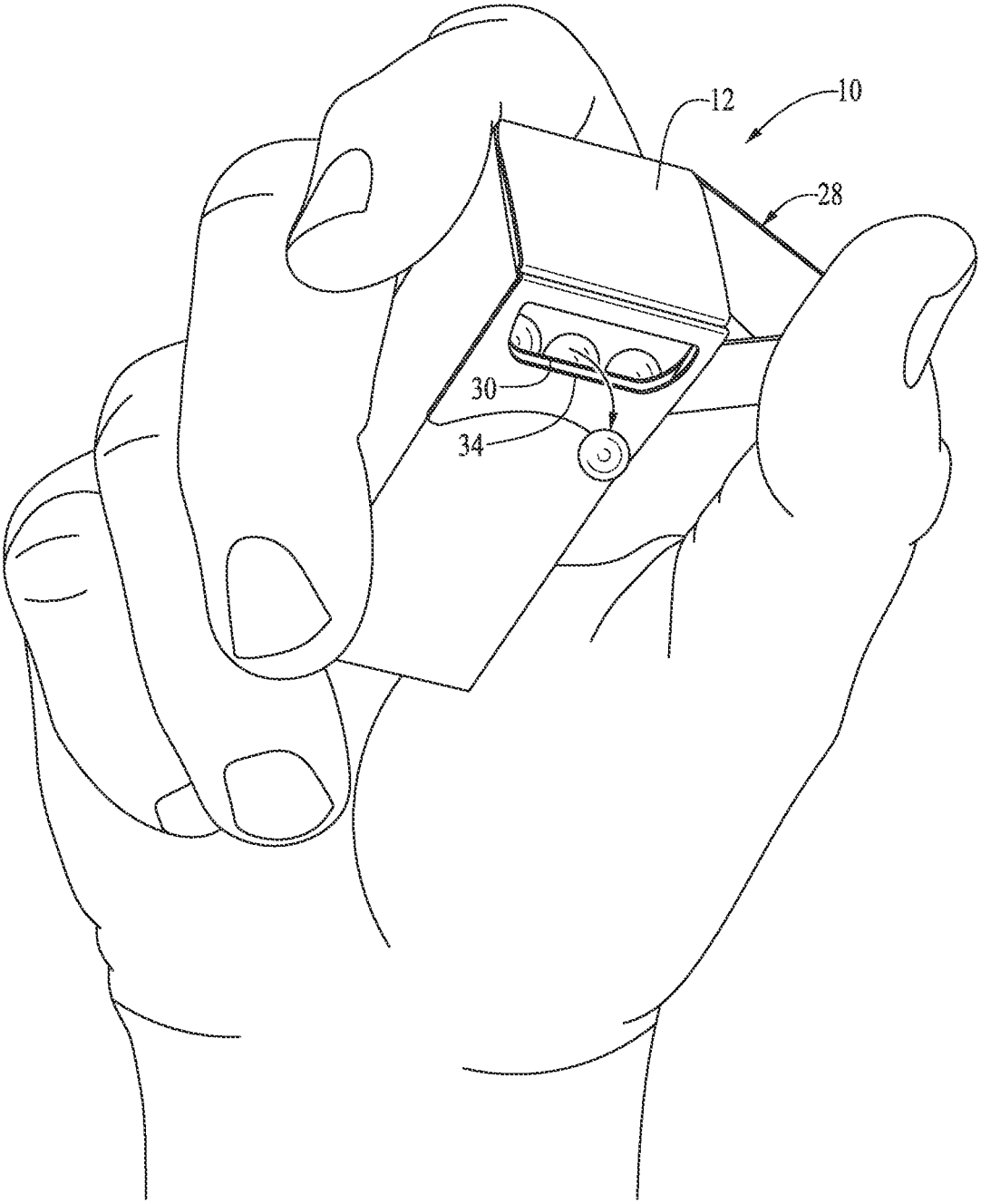
FIG. 6 is a perspective view of the box in a user's hand with the horizontal slide in an open position and product being dispensed.

FIG. 6 shows the box 10 being held in a user's right hand. Should the box 10 be used in the user's left hand (not shown) it may be turned about 90 degrees clockwise between the user's fingers and thumb to enable the user to use his or her left thumb to engage the slide tab 56 and move the slide 28 to dispense the product.

Figure 7:
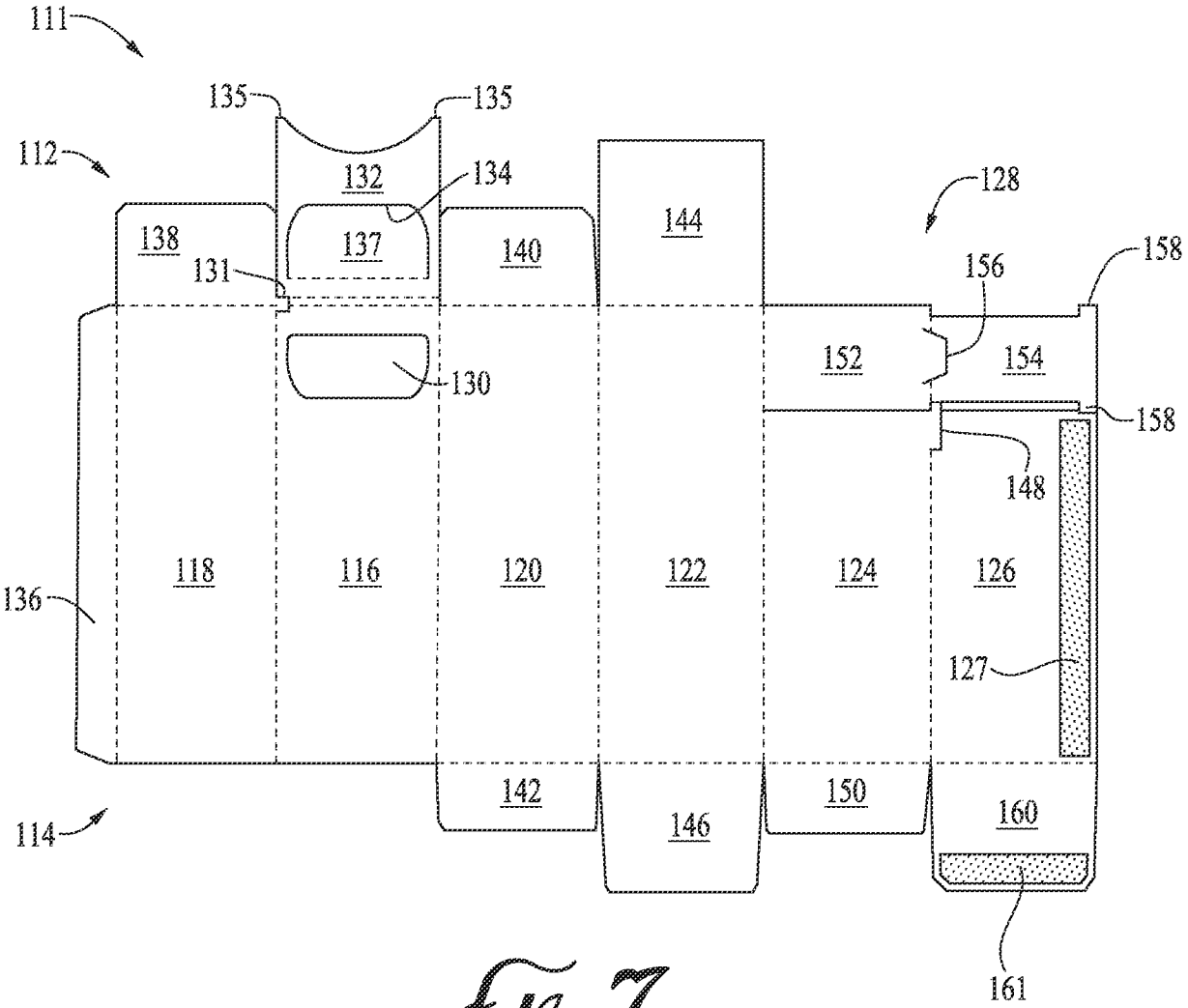
FIG. 7 is a flat pattern view of a single cardboard blank from which a second embodiment of the box is made.

FIG. 7 shows a second embodiment of a flat pattern of a single blank sheet or paper or cardboard stock 111 used to make a box 110 (FIGS. 8-12) for solid, pourable food products such as small candies or mints. The blank 111 has a top end 112 and a bottom end 114, and is scored for folding between six (6) major sides including an interior front panel 116, first side panel 118, second side panel 120, rear panel 122, third side panel 124 and exterior front panel 126.

Still referring to FIG. 7, a closing tab 136 is foldably connected to the first side panel 118, and the interior front panel 116 is foldably connected to the first side panel 118 opposite the closing tab 136. The first side panel 118 includes a first side panel top tab 138 foldably connected to the top end 112 of the first side panel 118. The interior front panel 116 includes a first aperture 130 adjacent the top end 112 of the interior front panel 116 and a front panel tab 132 foldably connected to the top end 112 of the interior front panel 116. A portion of the interior front panel 116 is cut away to form a first catch 131. The front panel tab 132 includes a second aperture 134 adjacent the bottom end 114 of the front panel tab 132 and preferably has a pair of ears 135 at the top end 112. Second aperture 134 is formed by flap 137. The ears 135 of the front panel tab 132, and the closing tab 136 foldably connected to the first side panel 118 may serve as areas to apply glue or other adhesive to hold the constructed box 110 together.

The second side panel 120 is foldably connected to the interior front panel 116 opposite the first side panel 118 and includes a second side panel top tab 140 foldably connected to the top end 112, and a second side panel bottom tab 142 foldably connected to the bottom end 114 of the second side panel 120. The rear panel 122 is foldably connected to the second side panel 120 opposite the interior front panel 116 and includes a rear panel top tab 144 foldably connected to the top end 112, and a rear panel bottom tab 146 foldably connected to the bottom end 114 of the rear panel 122.

Still referring to FIG. 7, the third side panel 124 is foldably connected to the rear panel 122 opposite the second side panel 120, and the exterior front panel 126 is foldably connected to the third side panel 124 opposite the rear panel 122. A portion of the third side panel 124 and exterior front panel 126 are cut away during manufacture to form a slide 128. The slide 128 includes a first portion 152 and second portion 154 and includes a cut such that when folded, forms a slide tab 156 configured for engagement by a user's thumb. Additionally, a portion of the exterior front panel 126 is cut away to form a second catch 148 that corresponds in configuration with a pair of slide stops 158 at the end of the second portion 154 of the slide 128. A portion of the exterior front panel 126 and the exterior front panel tab 160 preferably include a first adhesive area 127 and second adhesive area 161, respectively, to which glue or other adhesive may be applied prior or during construction of the box 110.

The box 110 is constructed by folding the blank 111 in a particular sequence such that no specialized automated packaging machinery is needed to insert the slide 128 within the box 110. Still referring to FIG. 1, the construction begins by folding up the closing tab 136, first side panel 118, interior front panel 116, second side panel 120, rear panel 122, third side panel 124 and exterior front panel 126, and folding across the middle portion of the slide 128 adjacent the slide tab 156. When all panels are folded, exterior front panel 126 overlaps with and is potentially glued to interior front panel 116 and closing tab 136 is glued to an interior surface of rear panel 122 proximate the fold line between rear panel 122 and third side panel 124. Aperture 130 is not covered by exterior front panel 126. Next, the second side panel bottom tab 142, rear panel bottom tab 146, third side panel bottom tab 150, and exterior front panel tab 160 may then be folded to close the bottom end 114 of the box 110.

Figure 8:
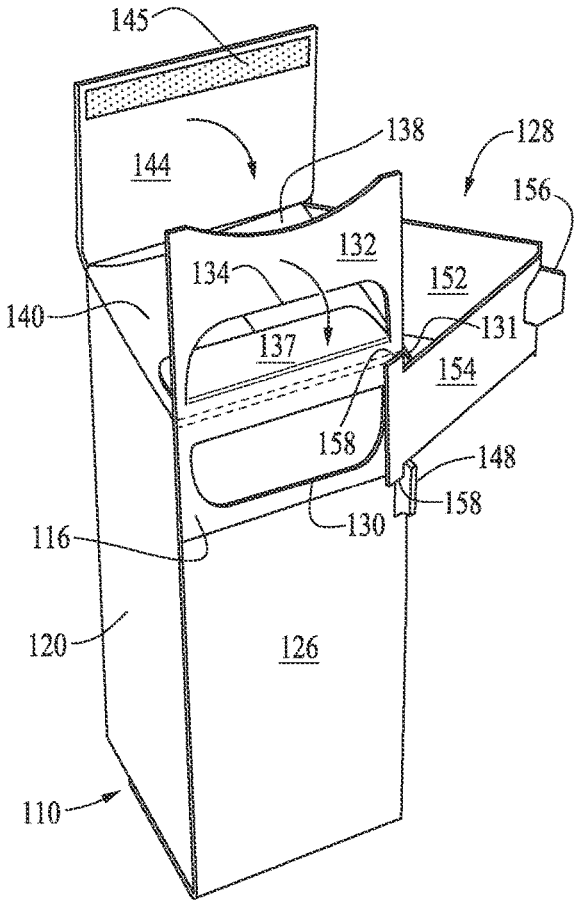
FIG. 8 is a front perspective view of the partially constructed box of the second embodiment showing the structure that provides the horizontal slide.

Referring to FIG. 8, assembly steps for folding the top 112 of the box include folding the first side panel top tab 138, second side panel top tab 140, rear panel top tab 144, and flap 137 substantially 90 degrees towards the interior of the box 110. The slide 128 is folded such that the first portion 152 overlaps the first side panel 118, and second portion 154 overlaps the interior front panel 116. The first catch 131 and second catch 148 prevent advancement of the slide stops 158 beyond the third side panel 124, and keep the slide 128 contained in the box 110. A Next, flap 132 is folded substantially 180 degrees such that the second aperture 134 and first aperture 130 are substantially aligned to form a single opening in the box 110. In this configuration, a space is formed between the interior front panel 116 and flap 132 to house the slide 128 there between. The final assembly step may be folding second side panel top tab 140, first side panel top tab 138, a rear panel top tab 144 and flap 137 substantially 90 degrees towards the interior of the box 110 such that the rear panel top tab 144 overlaps flap 137, adhesively connecting to one another via adhesive applied preferably to the second adhesive area 145, thereby forming the top end 112 of the box 110.

Figure 9:
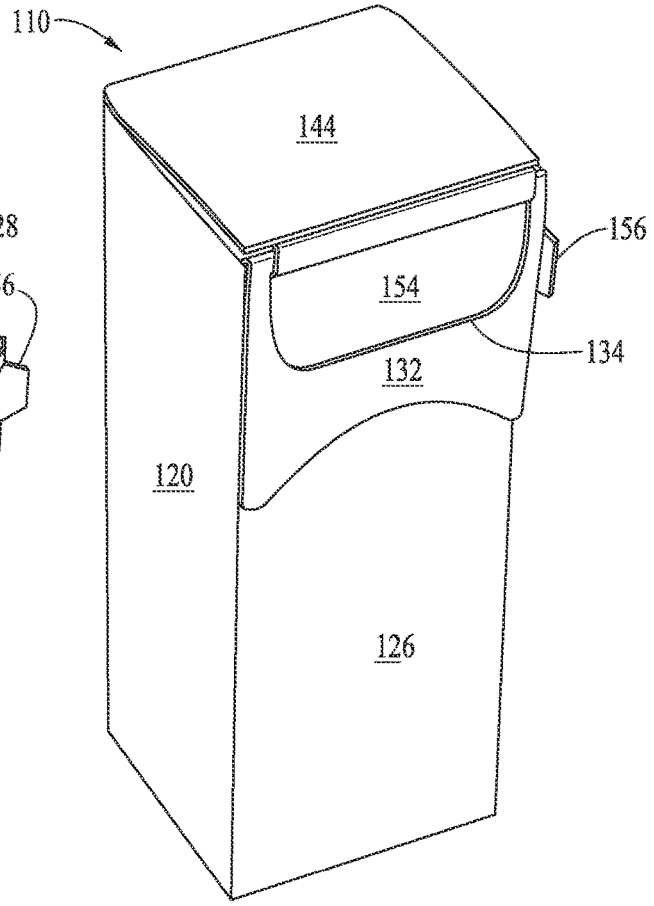
FIG. 9 is a front perspective view of the constructed box.

FIG. 9 shows the box 110 in complete assembly with the slide 128 contained within the box 110. Note that flap 137 is folded backwards under rear top panel 144. The advantage to having flap 137 is that the box 110 is now fully sealed.

Figure 10:
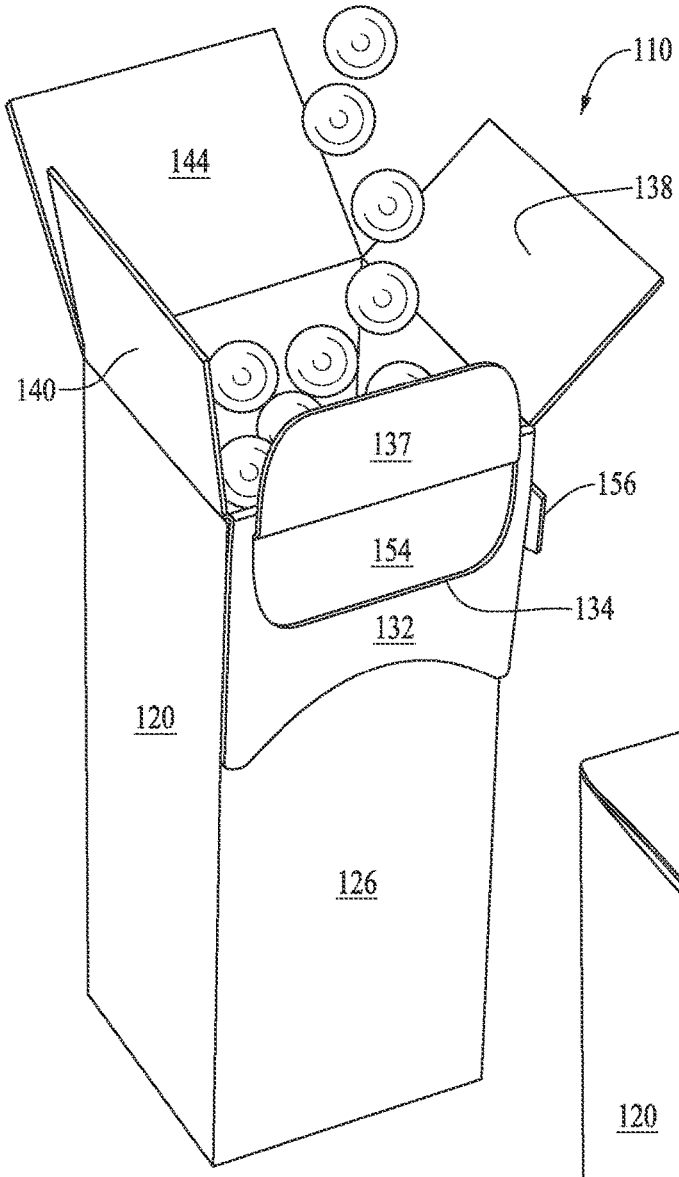
FIG. 10 is a front perspective view of the box being filled from the top.

FIG. 10 shows the fully-constructed box 110 being filled from the top, although the box 110 may be filled from the bottom (not shown).

Figure 11:
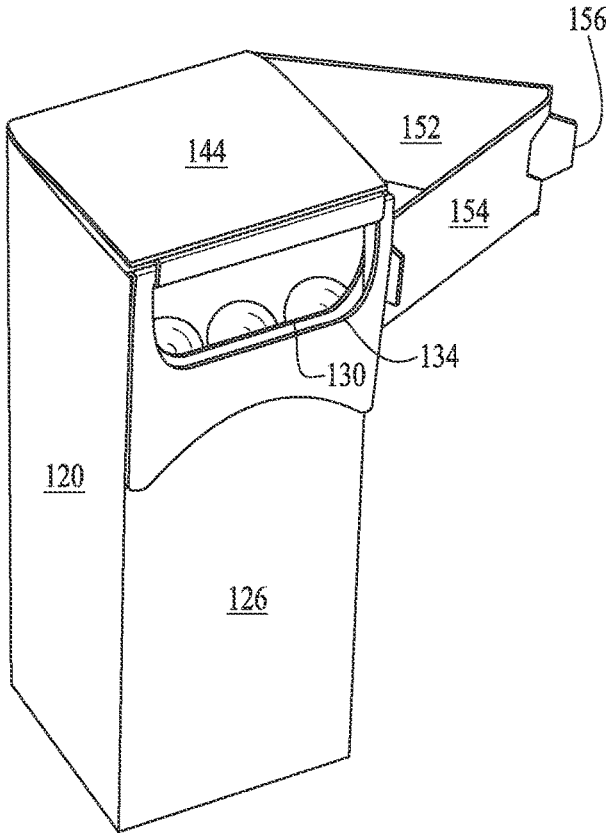
FIG. 11 is a front perspective view of the box showing operation of the horizontal slide.

FIG. 11 shows dispensing of product through the first aperture 130 and second aperture 134 after the slide 128 has been moved sideways unblocking the first aperture 130 and second aperture 134.

Figure 12:
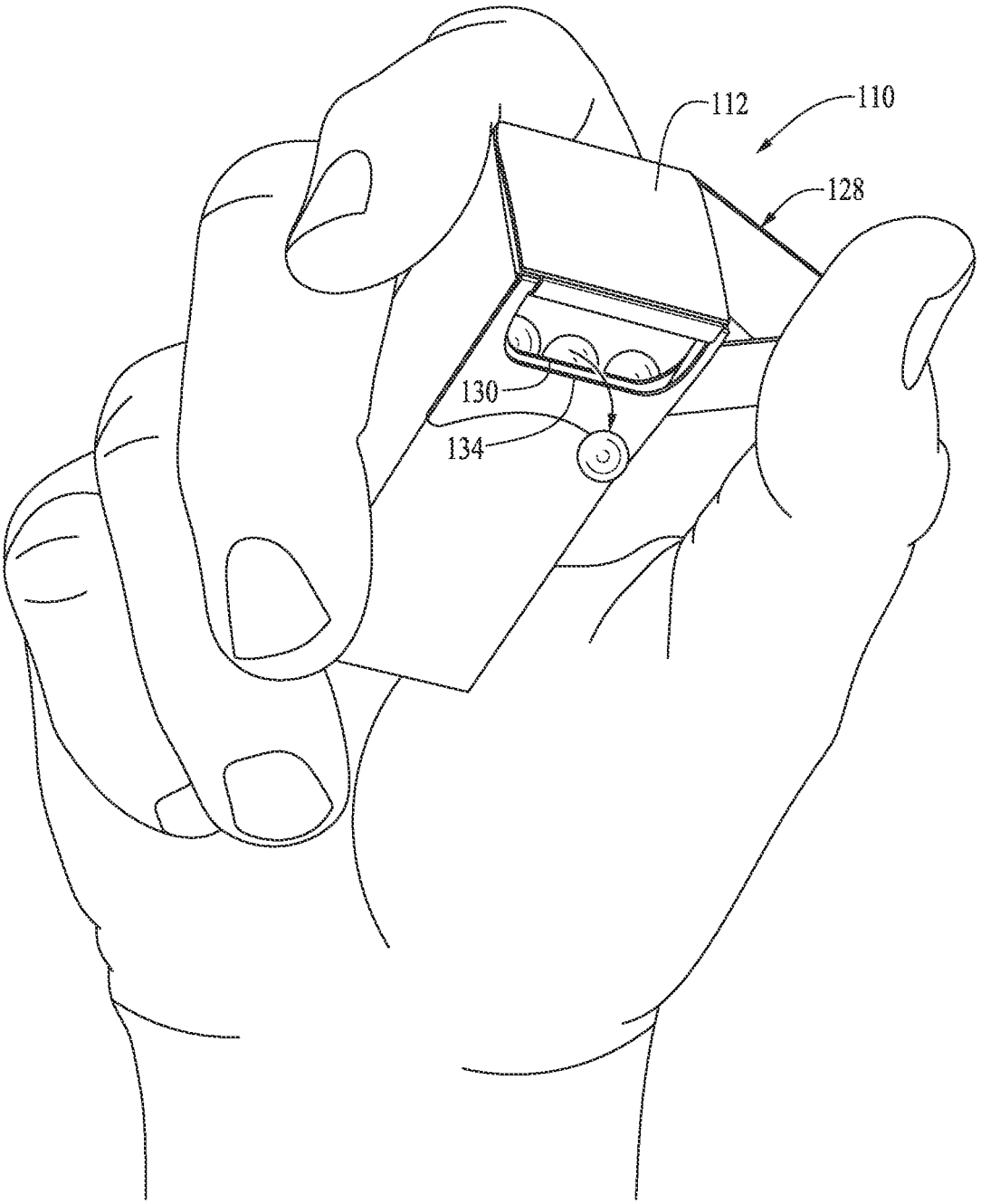
FIG. 12 is a perspective view of the box in a user's hand with the horizontal slide in an open position and product being dispensed.

FIG. 12 shows the box 110 being held in a user's right hand. Should the box 110 be used in the user's left hand (not shown) it may be turned about 90 degrees clockwise between the user's fingers and thumb to enable the user to use his or her left thumb to engage the slide tab 156 and move the slide 128 to dispense the product.

The present invention has the following advantages which include:

A smaller footprint, meaning, it costs less to manufacture and there is less waste because of its unique design;

It can be top-loaded with conventional box filling machinery, meaning, no special machinery is needed to fill it; and It offers convenient opening and closing mechanisms that allow the user to selectively open and close and access the contents, contributing the shareability of the product inside, and removing the need to actually touch the contents in order to access and share, perfect for a post-COVID world.

While particular forms of the invention have been illustrated and described, it will also be apparent to those skilled in the art that various modifications can be made without departing from the spirit and scope of the invention. Accordingly, it is not intended that the invention be limited except by the appended claims.

Although a very narrow claim is presented herein, it should be recognized the scope of this invention is much broader than presented by the claim. It is intended that broader claims will be submitted in an application that claims the benefit of priority from the application.

Insofar as the description above and the accompanying drawings disclose any additional subject matter that is not within the scope of the single claim below, the inventions are not dedicated to the public and the right to file one or more applications to claim such additional inventions is reserved.

What is claimed is:

1. A blank for folding into a box, the blank comprising:

a) a top end;

b) a bottom end;

c) an interior front panel having:

i) a first aperture adjacent the top end of the interior front panel; and ii) a front panel tab foldably coupled to the front panel, the front panel tab having a second aperture;

d) a first side panel foldably connected to the interior front panel, the first side panel having:

i) a closing tab foldably connected to the first side panel;

ii) a first side panel top tab foldably connected to the top end of the first side panel; and iii) a first catch;

e) a second side panel foldably connected to the interior front panel opposite the first side panel, the second side panel having:

i) a second side panel top tab foldably connected to the top end of the second side panel; and ii) a second side panel bottom tab foldably connected to the bottom end of the second side panel;

f) a rear panel foldably connected to the second side panel opposite the interior front panel, wherein the rear panel comprises:

i) a rear panel top tab foldably connected to the top end of the rear panel, the rear panel top tab having an insertion tab foldably connected thereto; and ii) a rear panel bottom tab foldably connected to the bottom end of the rear panel;

g) a third side panel foldably connected to the rear panel opposite the second side panel;

h) an exterior front panel foldably connected to the third side panel opposite the rear panel;

i) a slide formed by a portion of the third side panel and the exterior front panel, the slide having:

i) a first portion;

ii) a second portion having a pair of slide stops at an end of the second portion of the slide; and iii) a cut;

wherein when the slide is folded, a slide tab is formed that is configured for engagement with a user's thumb; and j) a second catch formed by a portion of the third side panel.

2. A method of folding the blank of claim 1, the method comprising the steps of:

a) folding up the closing tab, first side panel, interior front panel, second side panel, rear panel, third side panel and exterior front panel;

b) folding across a middle portion of the slide adjacent the slide tab;

c) gluing exterior front panel to interior front panel;

d) gluing closing tab to an interior surface of rear panel;

e) folding the second side panel bottom tab, rear panel bottom tab, third side panel bottom tab and exterior front panel tab to close the bottom end of the blank;

f) folding the first side panel top tab, second side panel top tab and rear panel top tab substantially 90 degrees;

g) folding the insertion tab substantially 90 degrees respective to the rear panel top tab such that the insertion tab inserts behind the top end of interior front panel;

h) folding the slide such that the first portion overlaps the first side panel, and second portion overlaps the interior front panel;

i) folding the front panel tab substantially 180 degrees such that the front panel tab overlaps the second portion of the slide, interior front panel and a portion of the exterior front panel, and the first aperture and second aperture align to form a single opening, thereby forming a space between the front panel tab and interior front panel to house the slide therebetween.

3. A blank for folding into a box, the blank comprising:

a) a top end;

b) a bottom end;

c) an interior front panel having:

i) a first aperture; and ii) a front panel tab foldably coupled to the front panel, the front panel tab having a second aperture;

d) a first side panel foldably connected to the interior front panel;

e) a second side panel foldably connected to the interior front panel opposite the first side panel;

f) a rear panel foldably connected to the second side panel opposite the interior front panel, wherein the rear panel comprises:

i) a rear panel top tab foldably connected to the top end of the rear panel, the rear panel top tab having an insertion tab foldably connected thereto; and ii) a rear panel bottom tab foldably connected to the bottom end of the rear panel;

g) a third side panel foldably connected to the rear panel opposite the second side panel;

h) an exterior front panel foldably connected to the third side panel opposite the rear panel;

i) a slide formed by a portion of the third side panel and the exterior front panel, the slide having:

i) a first portion;

ii) a second portion having a pair of slide stops at an end of the second portion of the slide; and iii) a cut; and wherein when the slide is folded, a slide tab is formed that is configured for engagement with a user's thumb; and j) a second catch formed by a portion of the exterior front panel.

4. The blank of claim 3, wherein the first side panel has:

a) a closing tab foldably connected to the first side panel;

b) a first side panel top tab foldably connected to the top end of the first side panel; and c) a first catch.

5. The blank of claim 3, wherein the second side panel has:

a) a second side panel top tab foldably connected to the top end of the second side panel; and b) a second side panel bottom tab foldably connected to the bottom end of the second side panel.

6. A blank for folding into a box, the blank comprising:

a) a top end;

b) a bottom end;

c) an interior front panel having:

i) a first aperture; and ii) a front panel tab foldably coupled to the front panel, the front panel tab having a second aperture;

d) a first side panel foldably connected to the interior front panel;

e) a second side panel foldably connected to the interior front panel opposite the first side panel;

f) a rear panel foldably connected to the second side panel opposite the interior front panel, wherein the rear panel has:

i) a rear panel top tab foldably connected to the top end of the rear panel, the rear panel top tab having an insertion tab foldably connected thereto; and ii) a rear panel bottom tab foldably connected to the bottom end of the rear panel;

g) a third side panel foldably connected to the rear panel opposite the second side panel;

h) an exterior front panel foldably connected to the third side panel opposite the rear panel; and i) a slide formed by a portion of the third side panel and the exterior front panel.

7. The blank of claim 6, wherein the first side panel has:

a) a closing tab foldably connected to the first side panel;

b) a first side panel top tab foldably connected to the top end of the first side panel; and c) a first catch.

8. The blank of claim 6, wherein the second side panel has:

a) a second side panel top tab foldably connected to the top end of the second side panel; and b) a second side panel bottom tab foldably connected to the bottom end of the second side panel.

9. The blank of claim 6, wherein the slide has:

a) a first portion;

b) a second portion having a pair of slide stops at an end of the second portion of the slide; and c) a cut;

wherein when the slide is folded, a slide tab is formed that is configured for engagement with a user's thumb.

* * * * *